US010051916B1

(12) United States Patent
Short et al.

(10) Patent No.: US 10,051,916 B1
(45) Date of Patent: Aug. 21, 2018

(54) METHOD AND APPARATUS FOR CUSTOMIZING INSOLES FOR FOOTWEAR

(71) Applicants: Timothy J. Short, Tucson, AZ (US); John P. Powers, Tucson, AZ (US)

(72) Inventors: Timothy J. Short, Tucson, AZ (US); John P. Powers, Tucson, AZ (US)

( * ) Notice: Subject to any disclaimer, the term of this patent is extended or adjusted under 35 U.S.C. 154(b) by 36 days.

(21) Appl. No.: 15/334,201

(22) Filed: Oct. 25, 2016

Related U.S. Application Data

(60) Provisional application No. 62/247,898, filed on Oct. 29, 2015.

(51) Int. Cl.

| | |
|---|---|
| ***A43B 17/00*** | (2006.01) |
| ***A43B 3/24*** | (2006.01) |
| ***A43B 17/02*** | (2006.01) |
| ***A43B 1/00*** | (2006.01) |
| ***A43B 7/14*** | (2006.01) |

(52) U.S. Cl.
CPC ..... *A43B 17/006* (2013.01); *A43B 1/0009* (2013.01); *A43B 1/0081* (2013.01); *A43B 3/246* (2013.01); *A43B 7/1465* (2013.01); *A43B 17/02* (2013.01)

(58) Field of Classification Search
CPC ... A43B 1/0009; A43B 1/0081; A43B 7/1465; A43B 7/148; A43B 17/006; A43B 17/02
See application file for complete search history.

(56) References Cited

U.S. PATENT DOCUMENTS 2,885,797 A * 5/1959 Chrencik ..... A43B 13/186 36/104
4,793,078 A * 12/1988 Andrews ..... A43B 7/142 36/43
5,154,682 A * 10/1992 Kellerman ..... A43B 1/0072 36/178
5,329,705 A * 7/1994 Grim ..... A43B 1/0009 36/110
5,768,803 A * 6/1998 Levy ..... A43B 7/1425 36/140
6,508,017 B1 1/2003 DeBarro et al. ..... 36/28
6,792,699 B2 * 9/2004 Long ..... A43B 1/0009 36/154
7,210,250 B2 * 5/2007 Gallegos ..... A43B 1/0054 36/140
7,493,230 B2 2/2009 Schwartz et al. ..... 702/139
7,770,309 B2 8/2010 Scofield ..... 36/165
8,201,346 B2 * 6/2012 Darby, II ..... A43B 7/00 36/100

FOREIGN PATENT DOCUMENTS

WO WO2016092353 6/2016 ..... A43B 7/14

OTHER PUBLICATIONS

M494-5PZ:—Alcantara®/Poron® insole product description, downloaded from http://bonapeda.com/Products/Off-Loading-Orthotics-and-Insoles/M494-5PZ on May 16, 2016 (1 pg).

* cited by examiner

*Primary Examiner* — Ted Kavanaugh
(74) *Attorney, Agent, or Firm* — Hayes Soloway P.C.

(57) ABSTRACT

A customizable insole has a base layer, a foot engaging top layer and a resiliently deformable layer therebetween. The top layer and the resiliently deformable layer are matrix cut into a plurality of adjacent plugs, wherein the plugs are removably fixedly bound to a base layer or a substrate. To customize an insole one or more plugs are removed in a spot to relieve pressure or reduce pain.

16 Claims, 1 Drawing Sheet

METHOD AND APPARATUS FOR CUSTOMIZING INSOLES FOR FOOTWEAR

CROSS-REFERENCE TO RELATED APPLICATIONS

This application claims priority from U.S. Provisional Application Ser. No. 62/247,898, filed Oct. 29, 2015, the contents of which are incorporated herein by reference.

FIELD OF THE INVENTION

The present invention relates to pedorthics for preventing and relieving foot problems. The present invention has particular applicability to insoles readily customized for an individual by a healthcare provider, or by the individual.

BACKGROUND OF THE INVENTION

Foot problems and the corresponding costs associated with foot care cost millions of dollars per year, just in the United States. In cases where the foot problem is debilitating for particular activities, hours of work time also can be lost. Foot problems can arise from medical conditions, work conditions requiring standing or walking, athletic activities, and/or leisure activity. Examples are pain in the ball of the foot because of a prominent metatarsal head, metatarsal deformity, intractable skin lesions on the plantar foot, bunions, warts, calluses and corns, and loss of fat pad of the ball of foot or heel associated with aging. Accommodative orthotics and inserts are the best conservative long term treatment, however many insurance policies do not pay for them unless they are made for treating a sudden injury (as opposed to a repetitive injury) or underlying risks associated with diabetes.

Pedorthics is the art concerned with the design, manufacture, fit, and modification of footwear and foot appliances as prescribed for relief of painful or disabling conditions of the foot. For those who practice any level of pedorthics, the goal is to provide protection and comfort to the consumer/patient. One of the primary ways of achieving this has been to reduce pressure at the greatest areas of impact. This has historically been accomplished with orthotics and/or external modifications to footwear.

One conventional method for providing protection and comfort to a consumer or patient is to use insoles inserted into footwear to cushion the sole of the foot. Health care providers (doctors and orthotists) are constantly modifying insoles for patients to accommodate painful areas of patient's feet. Often times doctors and orthotists use pads or make their own cut outs to accomplish this. There also are products that reduce pressure comprising removable insole that fits inside a shoe having selectively exchangeable arch inserts or heel inserts. See, for example, U.S. Pat. Nos. 6,508,017, and 7,770,309. There exists a need for a efficient and low cost system for customizing insoles to relieve specific pressure points for an individual.

SUMMARY OF THE INVENTION

The present invention provides a cost effective, easily customizable insole for footwear that can be used both by professional doctors and orthotists, and as an over-the-counter device customizable by a patient/consumer. More particularly, the present invention provides an insole comprised of a substrate carrying a plurality of individually removable plugs which form a foot supporting system. The plugs are formed of a resiliently deformable material such as a silicone gel, or open or closed cell foam having a top layer, and are removably fixed to a base layer or substrate which remains intact. Various durometer/thicknesses of open or closed cell foam may be used depending on the degree of accommodation the wearer needs. The removable plugs comprise a matrix of geometric cuts through the top of the insole, at least in part from the heel to toe in a geometric fashion, to the substrate. The base substrate is left intact, to maintain integrity of the insole. The plugs are fixed to the substrate with a low tack adhesive that allows selected geometric plugs to be removed leaving the substrate intact. In one embodiment the adhesive comprises a low tack B-stage adhesive that allows selected geometric plugs to be removed, but which adhesive then achieves a secondary cure by exposure to heat and/or humidity accumulating in the footwear when the footwear is worn.

In one embodiment there is provided a customizable insole comprising a base layer, a foot engaging top layer and a resiliently deformable layer therebetween, wherein the top layer and the resiliently deformable layer are matrix cut into a plurality of adjacent plugs, wherein said plugs are removably fixedly bound to the base layer which remains intact. In such embodiment all the plugs have the same size and shape, or have different sizes and shapes and/or different densities in selected areas.

In a preferred embodiment the plugs are hexagonal in shape, wherein the hexagonal plugs preferably are 0.5 to 2.0 cm on a side, more preferably 1.0 to 2.0 cm on a side, most preferably about 1.5 on a side.

The invention also provides a method for making a customized insole for an individual comprising providing an insole as above described, and selectively removing plugs from portions of the insole.

In one embodiment, all the plugs have the same size and shape, or have different sizes and shapes, and/or have different densities in selected areas.

In a preferred embodiment the plugs are hexagonal in shape, are 0.5 to 2.0 cm on a side, more preferably 1.0 to 2.0 cm on a side, most preferably about 1.5 on a side.

BRIEF DESCRIPTION OF THE DRAWINGS

Further features and advantages of the present invention will be seen from the following detailed description, taken in conjunction with the accompanying drawings, wherein like numerals like parts, and wherein.

DETAILED DESCRIPTION

Figure 1:
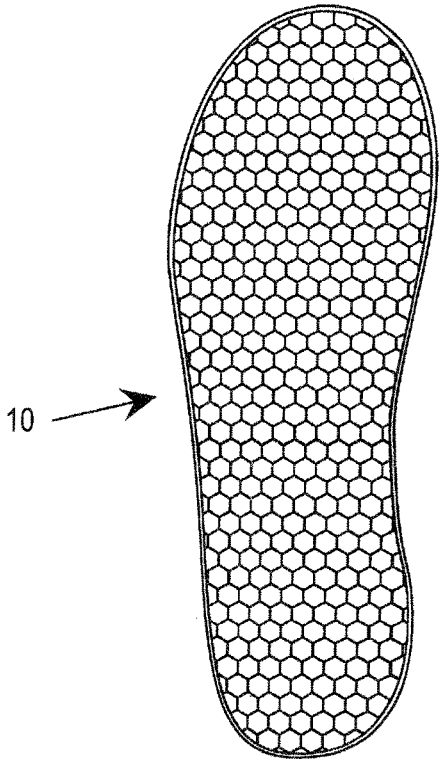
FIGS. 1 and 2 are top and bottom plan views of a customizable insole in accordance with the present invention.
Figure 2:
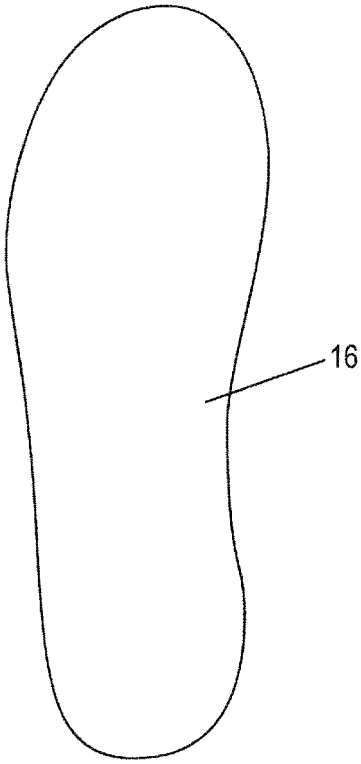
Figure 3:
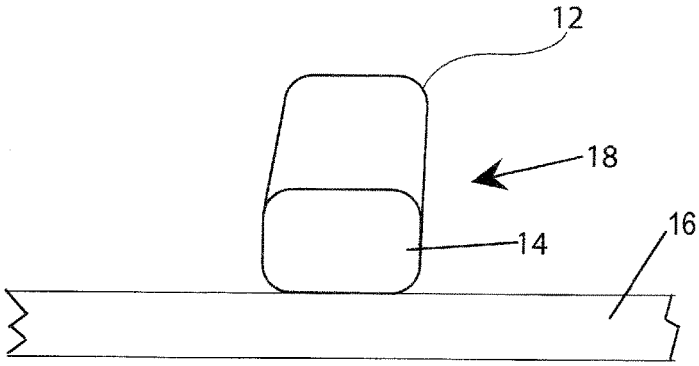
FIG. 3 is a perspective view of a removable plug element of the insole of the present invention.

Referring to FIGS. 1-3, the present invention comprises customizable insole 10 having a foot supporting surface 12 typically formed of a fabric. Alternatively, top layer 12 may be formed of a leather or synthetic material. Top layer 12 is fixed to an open or closed cell foam material 14, which in turn is fixed to a bottom layer 16 by an adhesive of sufficient strength under normal circumstances to maintain the integrity of the assembly, but having sufficient low tack so that individual plugs may be removed. In a preferred embodiment the adhesive comprises a low tack B-stage adhesive that allows selected geometric plugs to be removed, but which adhesive then achieves a secondary cure by exposure to heat and/or humidity accumulating in the footwear when the footwear is worn. Top layer 12 and foam layer 14 are matrix cut into geometric shapes from the top layer through the foam layer to form a plurality of plugs 18. However, the bottom layer 16 is uncut so as to maintain integrity of the insole 10. The geometric cuts may take a variety of shapes and may be the same or different sizes. In a preferred embodiment, the plugs 18 are formed in identical regular hexagonal shapes and sizes, typically 0.5-2.0 cm on a side, preferably 1.0-2.0 cm on a side, more preferably about 1.5 cm on a side.

In order to customize an insole for a particular wearer, it is a simple matter to remove one or more plugs in a spot to relieve pressure or reduce pain. As an example a wearer may have a prominent $2^{nd}$ metatarsal head causing pain and callus formation. The wearer or care provider would remove one or more hexagonal plugs under the second metatarsal to relieve pressure and reduce pain.

The insole may be customized by a healthcare provider, or alternatively sold over-the-counter for customization by the consumer.

Various changes may be made in the invention without departing from the spirit and scope thereof. For example, the insole may be packaged with plugs similar in hexagonal shapes as plugs 18, but having a reduced thickness so that selected plugs may be removed and replaced with reduced thickness plugs for further customization. The replacement plugs should have a pressure sensitive adhesive on one side so that the plugs may be fixed to the bottom layer 16. Still other changes may be possible without departing from the spirit and scope of the invention.

The invention claimed is:

1. A customizable insole comprising a base layer, a foot engaging top layer and a resiliently deformable layer therebetween, wherein the top layer and the resiliently deformable layer are matrix cut into a plurality of adjacent plugs, wherein said plugs are initially individually removably fixed to the base layer by a B-stage adhesive, which plugs become permanently fixed to the base layer after the adhesive achieves a secondary cure upon exposure to heat and/or humidity.

2. The insole according to claim 1, wherein all the plugs have the same size and shape.

3. The insole according to claim 1, wherein the plugs have different sizes and shapes.

4. The insole according to claim 1, wherein the plugs have different densities in selected areas.

5. The insole according to claim 1, wherein the plugs are hexagonal in shape.

6. The insole according to claim 5, wherein the hexagonal plugs are 0.5 to 2.0 cm on a side.

7. The insole according to claim 5, wherein the hexagonal plugs are 1.0 to 2.0 cm on a side.

8. The insole according to claim 5, wherein the hexagonal plugs are about 1.5 on a side.

9. A method making a customized insole for an individual comprising providing an insole having a plurality of removable plugs as claimed in claim 1, modifying the insole by selectively removing plugs from portions of the insole, and exposing the modified insole to heat and/or humidity to achieve a secondary cure, and permanently bond plugs not removed to the base layer.

10. The method according to claim 9, wherein all the plugs have the same size and shape.

11. The method according to claim 9, wherein the plugs have different sizes and shapes.

12. The method according to claim 9, wherein the plugs have different densities in selected areas.

13. The method according to claim 9, wherein the plugs are hexagonal in shape.

14. The method according to claim 13, wherein the hexagonal plugs are 0.5 to 2.0 cm on a side.

15. The method according to claim 13, wherein the hexagonal plugs are 1.0 to 2.0 cm on a side.

16. The method according to claim 13, wherein the hexagonal plugs are about 1.5 on a side.

* * * * *